US007627276B2

(12) United States Patent
Anan et al.

(10) Patent No.: US 7,627,276 B2
(45) Date of Patent: Dec. 1, 2009

(54) DEVELOPING ROLLER, ELECTROPHOTOGRAPHIC PROCESS CARTRIDGE, AND ELECTROPHOTOGRAPHIC IMAGE FORMING APPARATUS

(75) Inventors: Genya Anan, Numazu (JP); Kenichi Yamauchi, Susono (JP); Hidenori Satoh, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/200,174

(22) Filed: Aug. 28, 2008

(65) Prior Publication Data

US 2008/0317515 A1 Dec. 25, 2008

Related U.S. Application Data

(63) Continuation of application No. PCT/JP2008/057649, filed on Apr. 15, 2008.

(30) Foreign Application Priority Data

Apr. 27, 2007 (JP) ..... 2007-118781

(51) Int. Cl.
*G03G 15/08* (2006.01)

(52) U.S. Cl. ..... 399/286

(58) Field of Classification Search ..... 399/286, 399/265, 279; 492/53, 54, 56; 428/447, 428/448, 450, 451
See application file for complete search history.

(56) References Cited

U.S. PATENT DOCUMENTS

| | | | | |
|---|---|---|---|---|
| 4,836,136 | A | 6/1989 | Natsuhara | |
| 5,462,800 | A * | 10/1995 | Yamazaki et al. | 428/448 |
| 7,153,580 | B2 * | 12/2006 | Rose et al. | 428/447 |
| 2003/0157418 | A1 * | 8/2003 | Lee et al. | |

FOREIGN PATENT DOCUMENTS

| | | | |
|---|---|---|---|
| JP | 63-217379 | A | 9/1988 |
| JP | 3-100680 | A | 4/1991 |
| JP | 3-233580 | A | 10/1991 |
| JP | 9-62086 | A | 3/1997 |
| JP | 2006-227447 | A | 8/2006 |
| JP | 2006-337622 | A | 12/2006 |
| JP | 2007-101768 | A | 4/2007 |

* cited by examiner

*Primary Examiner*—Susan S Lee
(74) *Attorney, Agent, or Firm*—Fitzpatrick, Cella, Harper & Scinto

(57) ABSTRACT

A developing roller is provided having a surface that has excellent effect of suppressing exudation of low molecular weight substances from an elastic body, excellent toner release properties, and sufficient flexibility in which cracks do not easily occur even by repeated image formation. The developing roller carries and conveys toner to develop electrostatic latent images on a photosensitive drum with the toner and includes in this order a mandrel, an elastic layer, and a surface layer. The surface layer includes a silicon oxide film containing carbon atoms chemically bonded to silicon atoms. The silicon oxide film has an abundance ratio of oxygen atoms forming chemical bonds with silicon atoms to silicon atoms (O/Si) of 0.65 or more and 1.95 or less, and an abundance ratio of carbon atoms forming chemical bonds with silicon atoms to silicon atoms (C/Si) of 0.05 or more and 1.65 or less.

8 Claims, 4 Drawing Sheets

DEVELOPING ROLLER, ELECTROPHOTOGRAPHIC PROCESS CARTRIDGE, AND ELECTROPHOTOGRAPHIC IMAGE FORMING APPARATUS

This application is a continuation of International Application No. PCT/JP2008/057649, filed Apr. 15, 2008, which claims the benefit of Japanese Patent Application No. 2007-118781, filed Apr. 27, 2007.

BACKGROUND OF THE INVENTION

1. Field of the Invention

The present invention relates to a developing roller used in an electrophotographic image forming apparatus, such as a copying machine and a laser printer, and an electrophotographic process cartridge and electrophotographic image forming apparatus which are provided with the developing roller.

2. Related Background Art

A contact development method in which a developing roller having an elastic layer is brought into contact with a photosensitive drum for development is proposed as a development method in which an electrostatic latent image on a photosensitive drum is visualized with a toner.

The developing roller used for contact development is brought into contact with a contact member while conveying a toner. Therefore, when the surface of the developing roller has strong tackiness, the conveyed toner may remain attached on the developing roller. The toner attached to the developing roller surface in this manner may degrade gradually by subsequent repeated contact of the developing roller and the photosensitive drum, and finally melted and adhered to the developing roller surface, causing filming.

As measures against such toner filming, Japanese Patent Application Laid-Open No. H09-062086 proposes a developing roller with an elastic layer that has good charging properties for toner and suppresses filming by sprinkling and attaching inorganic particles having release properties for toner onto the surface of the elastic layer.

SUMMARY OF THE INVENTION

However, according to the study of the present inventors, the above-described inorganic particles were attached lightly to the surface, so that the inorganic particles were easily detached during use, and it was difficult to sustain the effect of suppressing filming for a long period.

Also, the developing roller having the elastic layer may affect image quality and the lifetime of the photosensitive drum.

It is necessary to suppress the attachment of low molecular weight substances exuding from the elastic layer to the photosensitive drum, but it was difficult to prevent well the attachment of the low molecular weight substances to the photosensitive drum by the developing roller according to the invention described in Japanese Patent Application Laid-Open No. H09-062086.

A developing roller of a type in which the surface of the elastic layer is coated with at least one resin is mentioned as a conventional measure against toner filming in the specification of Japanese Patent Application Laid-Open No. H09-062086. It is described that in such a developing roller, there was a problem in reliability because the coating layer was insufficient in flexibility and adhesiveness to the elastic body.

Then, with the intention of further stabilizing high-quality electrophotographic images according to contact development, the present inventors arrived at recognition that it is important to develop a developing roller having a surface layer that can effectively suppress the exudation of low molecular weight components from the elastic layer, has a surface excellent in toner release properties, and has sufficient flexibility, and does not easily cause cracks even when repeatedly subjected to image formation.

Therefore, the subject of the present invention is to provide a developing roller having a surface layer that satisfies the above requirements 1 to 3.

In order to solve the above subject, the present inventors diligently conducted studies, found that it is necessary to specify material for forming a surface layer, and finally arrived at the present invention.

According to one aspect of the present invention, there is provided a developing roller for carrying and conveying toner and developing an electrostatic latent image on a photosensitive drum with the toner, the developing roller comprising in this order an mandrel, an elastic layer, and a surface layer, wherein the surface layer comprises a silicon oxide film containing a carbon atom chemically bonded to a silicon atom, the silicon oxide film having an abundance ratio of an oxygen atom forming a chemical bond with a silicon atom to a silicon atom (O/Si) of 0.65 or more and 1.95 or less, and an abundance ratio of the carbon atom chemically bonded to a silicon atom to a silicon atom (C/Si) of 0.05 or more and 1.65 or less.

According to another aspect of the present invention, there is provided an electrophotographic process cartridge that is detachably mountable on an electrophotographic image forming apparatus body, wherein a developing roller set in the cartridge is the above described developing roller.

According to further aspect of the present invention, there is provided an electrophotographic image forming apparatus including a photosensitive drum and a developing roller placed in contact with the photosensitive drum, wherein the developing roller is the above described developing roller.

According to the developing roller of the present invention, the exudation of low molecular weight substances from the elastic layer can be effectively suppressed. In other words, even when the developing roller is contacted with an electrophotographic photosensitive member for a long time, the attachment of low molecular weight substances exuding from the elastic layer to the surface of the electrophotographic photosensitive body is effectively suppressed. As a result, high-quality electrophotographic images can be stably provided. Further, according to the developing roller of the present invention, filming on the surface of the developing roller is inhibited from occurring, so that images can be stably formed. Moreover, according to the developing roller of the present invention, peeling of the surface layer of the developing roller associated with use can be effectively suppressed. Therefore, a further improvement in the durability of the developing roller can be achieved.

DESCRIPTION OF THE EMBODIMENTS

Figure 1:
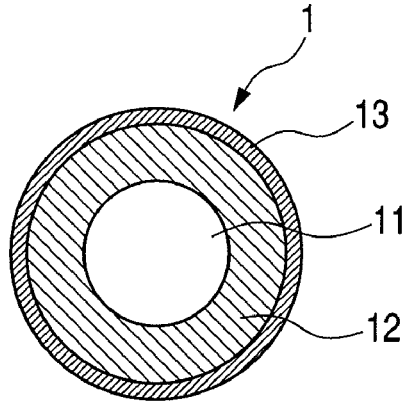
FIG. 1 is a cross-sectional view of an example of a developing roller.

A cross-sectional view of one example of the developing roller of the present invention is shown in FIG. 1.

The developing roller 1 of the present invention usually has a mandrel 11 formed of conductive material, such as metal. At least one elastic layer 12 is on the outer peripheral surface of the mandrel 11, and at least one surface layer 13 is further superposed on the outer peripheral surface.

(Mandrel 11)

The mandrel 11 is columnar in this figure, but may be hollow cylindrical.

Developing roller 1 is generally used, with an electrical bias applied or grounded. Thus, the mandrel 11 is a support member, and preferably, is made of a conductive material so that at least the surface of the mandrel 11 can be conductive. Therefore, in the mandrel 11, at least the outer peripheral surface is made of conductive material that is sufficient to apply a predetermined voltage to the elastic layer 12 formed on the outer peripheral surface. The following may be exemplified as the configurations of specific mandrels:

Mandrels made of one of metals and alloys, such as Al, Cu alloys, and SUS;

Mandrels made of iron having a surface provided with Cr or Ni plating; and

Mandrels made of a synthetic resin having a surface provided with Cr or Ni plating.

In a developing roller used for an electrophotographic image forming apparatus, usually, it is appropriate that the mandrel 11 has an outer diameter in a range of 4 mm to 10 mm.

(Elastic Layer 12)

The elastic layer 12 is formed using one of rubbers and resins as the main component of the raw material. Various rubbers conventionally used for a developing roller may be used as the rubber that is the main component of the raw material. Specifically, the following is cited: ethylene-propylene-diene copolymer rubbers (EPDM), acrylonitrile-butadiene rubbers (NBR), chloroprene rubbers (CR), natural rubbers (NR), isoprene rubbers (IR), styrene-butadiene rubbers (SBR), fluororubbers, silicone rubbers, epichlorohydrin rubbers, NBR hydrides, polysulfide rubbers, and urethane rubbers.

The resin, which is the main component of the raw material, is mainly a thermoplastic resin, and includes the following: polyethylene resins, such as low-density polyethylene (LDPE), high-density polyethylene (HDPE), linear low-density polyethylene (LLDPE), and ethylene-vinyl acetate copolymer resins (EVA); polypropylene resins; polycarbonate resins; polystyrene resins; ABS resins; polyimide; polyester resins, such as polyethylene terephthalate and polybutylene terephthalate; fluororesins; polyamide resins, such as polyamide 6, polyamide 66, and MXD6.

These rubbers and resins may be used singly or in a mixture of two or more of them.

Further, in the developing roller of the present invention, the rubber material, which is the main component, may be appropriately blended with components necessary for the functions required for the elastic layer itself, such as a conductive agent and a non-conductive filler, and various additive components used for forming a rubber and resin molded body, for example, a crosslinking agent, a catalyst, and a dispersing agent.

The conductive agent includes an ion conductive substance based on an ion conducting mechanism, and a conductivity providing agent based on an electron conducting mechanism, and either or both the ion conductive substance and the conductivity providing agent may be used.

The conductive agent based on an electron conducting mechanism includes the following: powders and fibers of metal, such as aluminum, palladium, iron, copper, and silver; metal oxides, such as titanium oxide, tin oxide, and zinc oxide; powders of metal compounds, such as copper sulfide and zinc sulfide; powders composed of suitable particles whose surfaces tin oxide, antimony oxide, indium oxide, molybdenum oxide, zinc, aluminum, gold, silver, copper, chromium, cobalt, iron, lead, platinum, or rhodium is attached to by electrolysis processing, spray coating, or mixing and shaking; carbon black type conductive agents, such as acetylene black, Ketjen Black (trade name), PAN carbon black, pitch carbon black, and carbon nanotubes.

The conductivity providing agent based on an ion conducting mechanism includes the following: alkali metal salts, such as $LiCF_3SO_3$, $NaClO_4$, $LiClO_4$, $LiAsF_6$, $LiBF_4$, NaSCN, KSCN, and NaCl; ammonium salts, such as $NH_4Cl$, $NH_4SO_4$, and $NH_4NO_3$; alkaline earth metal salts, such as $Ca(ClO_4)_2$ and $Ba(ClO_4)_2$; complexes of these salts and polyalcohols, such as 1,4-butanediol, ethylene glycol, polyethylene glycol, propylene glycol, and polypropylene glycol, and their derivatives; complexes of these salts and monools, such as ethylene glycol monomethyl ether, ethylene glycol monoethyl ether, polyethylene glycol monomethyl ether, and polyethylene glycol monoethyl ether; cationic surfactants, such as quaternary ammonium salts; anionic surfactants, such as aliphatic sulfonate, alkyl sulfate, and alkyl phosphate; amphoteric surfactants, such as betaine.

These conductive agents can be used singly or in a mixture of two or more of them.

In addition, a method of adding a conductive polymer compound instead of, or along with, the conductive agent, may also be used as a means for imparting conductivity to the elastic layer.

A conductive polymer compound refers to a polymer compound including a polymer having a conjugated system, such as polyacetylene, as a host polymer, which is doped with a dopant, such as $I_2$, for conductivity.

The host polymer includes, for example, the following: polyacetylene, poly(p-phenylene), polypyrrole, polythiophenine, poly(p-phenylene oxide), poly(p-phenylene sulfide), poly(p-phelene vinylene), poly(2,6-dimethylphenylene oxide), poly(bisphenol A carbonate), polyvinylcarbazole, polydiacetylene, poly(N-methyl-4-vinylpyridine), polyaniline, polyquinoline, and poly(phenylene ether sulfone).

The dopant includes, in addition to $I_2$, the following: halogens, such as $Cl_2$, $Br_2$, ICl, $ICl_3$, IBr, and $IF_3$; Lewis acids, such as $PF_5$, $AsF_5$, $SbF_5$, $FeCl_3$, $AlCl_3$, and $CuCl_2$; alkali metals, such as Li, Na, Rb, and Cs; alkaline earth metals, such as Be, Mg, Ca, Sc, and Ba; aromatic sulfonic acids, such as para-toluenesulfonic acid, benzenesulfonic acid, anthraquinonesulfonic acid, naphthalenesulfonic acid, naphthalenedisulfonic acid, and naphthalenetrisulfonic acid, or their alkali metal salts.

Among these, the carbon black type conductive agents are easily available at relatively low costs and can also provide good conductivity without depending on the types of rubber and resin materials which are the main component, and hence, are preferable. The following means conventionally used may be appropriately used, according to the rubber and resin materials that are the main component, as means for dispersing a fine powder conductive agent into the rubber and resin materials that are the main component. For example, roll kneaders, Banbury mixers, ball mills, sand grinders, and paint shakers may be cited.

A filler and an extender include the following: silica, quartz fine powder, diatomaceous earth, zinc oxide, basic magnesium carbonate, active calcium carbonate, magnesium silicate, aluminum silicate, titanium dioxide, talc, mica powder, aluminum sulfate, calcium sulfate, barium sulfate, glass fiber, organic reinforcing agents, and organic fillers.

The surfaces of these filler particles may be treated with an organosilicon compound for hydrophobicity.

Known antioxidants used for a polymer compound, such as hindered phenol antioxidants, phenol antioxidants, phosphorus antioxidants, amine antioxidants, and sulfur antioxidants, may be appropriately selected and used as an antioxidant.

Known materials may be used as a processing aid. Specifically, fatty acids, such as stearic acid and oleic acid, and metal salts and esters of fatty acids may be used.

For example, in order to form a rubber molded body from silicone rubber, liquid silicone rubber as a main agent, polyorganohydrogen siloxane as a crosslinking component, and a platinum catalyst are used to crosslink the rubber components with each other.

In order to come in contact with a photosensitive drum to assure a nip width and, in addition, to satisfy suitable set properties, the thickness of the elastic layer is preferably 0.5 mm or more and more preferably 1.0 mm or more. There is no particular upper limit of the thickness of the elastic layer unless the precision of the outer diameter of the developing roller is impaired. Practically, the thickness of the elastic layer can be 6.0 mm or less and particularly 5.0 mm or less. The thickness of the elastic layer is appropriately determined according to the hardness of the elastic layer to achieve the intended nip width.

In the present invention, the molding of this elastic layer may be performed by conventionally known extrusion molding methods, injection molding methods, and the like, but is not particularly limited. The layer configuration is not limited as long as having the features described in the present invention, and may include two or more layers.

The tensile modulus of the elastic layer having a surface layer is not particularly limited, but is preferably 1.0 MPa or more and 100.0 MPa or less, and more preferably 1.0 MPa or more and 30.0 MPa or less. When the tensile modulus of the elastic layer having a surface layer is set to be in the above numerical value range, even if the developing roller is left standing in contact with a contact member, such as an electrophotographic photosensitive member, for a long period, pressure contact permanent deformation does not occur easily in the contact portion of the developing roller. Also, the pressure applied to the toner passing between the contact member and the developing roller is not too large, so that the detachment and embedment of the external additive of the toner, and the exudation of wax and the like in the toner can be effectively suppressed.

Figure 2:
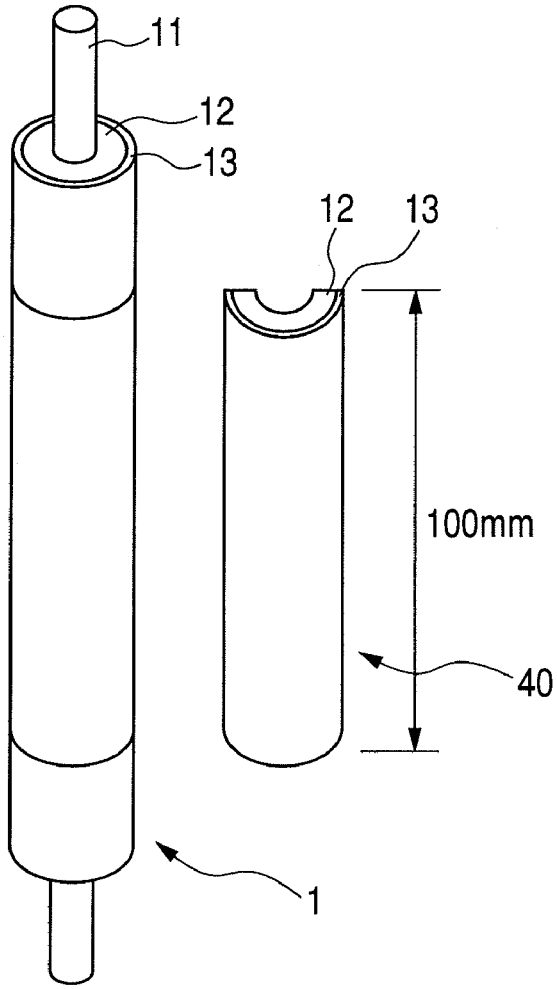
FIG. 2 is an explanatory view illustrating a method for taking a test piece for tensile modulus measurement.

The tensile modulus in the present invention is measured according to the method described in JIS-K7113 (1995). In the present invention, as illustrated in FIG. 2, a sample is cut out of the developing roller 1 in a length of 100 mm corresponding to half the circumference of the roller to provide a test piece 40 for tensile modulus measurement.

The universal tensile tester "Tensilon RTC-1250A" (trade name, manufactured by ORIENTEC CO., LTD.) is used for measurement. The measurement environment is set at a temperature of 20° C. and a humidity of 60% RH. Measurement is performed attaching 10 mm of each end of the test piece to a chuck, at a chuck-to-chuck length of 80 mm and a measurement speed of 20 mm/min. The average value of the obtained tensile modulus of five specimens is calculated and defined as the tensile modulus of the elastic layer having a surface layer in the developing roller.

(Surface Layer 13)

The developing roller of the present invention has the surface layer 13 covering the surface of the elastic layer 12, as illustrated in FIG. 1. The surface layer includes a silicon oxide film (hereinafter referred to also as a "SiOx film") containing a carbon atom chemically bonded to a silicon atom. In other words, the SiOx film included in the surface layer 13 has chemical bonds of Si—O and Si—C. The abundance ratio of an oxygen atom chemically bonded to a silicon atom to a silicon atom (O/Si) is 0.65 or more and 1.95 or less. The abundance ratio of the carbon atom forming a chemical bond with a silicon atom to a silicon atom (C/Si) is 0.05 or more and 1.65 or less.

The abundance ratio O/Si is more preferably 1.30 or more and 1.80 or less. If the abundance ratio O/Si is less than 0.65, it is difficult to inhibit contaminants from exuding from the elastic layer, so that a problem is raised in contamination of the photosensitive drum in some case when the surface layer is used for the developing roller. If the abundance ratio is more than 1.95, the SiOx film itself is hard, and is liable to crack, so that streaks are likely to occur in the resulting images due to cracks when the surface layer is used for the developing roller.

The abundance ratio C/Si is more preferably 0.10 or more and 0.70 or less. If the abundance ratio C/Si is less than 0.05, the adhesion of the silicon oxide film and the elastic layer surface decreases, so that it is difficult to obtain a uniform and suitable surface layer. If the abundance ratio C/Si is more than 1.65, the surface of the film is liable to become tacky (sticky), and when the surface layer is used for the developing roller, release properties for toner is lowered, so that filming is apt to occurs.

The abundance ratio of each element in the surface layer is obtained as follows.

Using the X-ray photoelectron spectrometer "Quantum 2000" (trade name, manufactured by ULVAC-PHI, Inc.) and using AlKα as an X-ray source, peaks caused by the bond energy of the 2p orbital of Si and the is orbital of O and C are measured on the surface of the surface layer 13 of the developing roller. The abundance ratio of each atom is calculated from each peak, and O/Si and C/Si are found from the abundance ratio.

The chemical bonds of SiOx are confirmed by IR measurement of the surface of the SiOx film constituting the surface layer 13 of the developing roller by the Fourier transform infrared spectrometer (FT-IR) "SpectrumOne" (trade name, manufactured by PerkinElmer Japan Co., Ltd.). In other words, the presence of chemical bonds of Si—O and Si—C is confirmed by the presence of a Si—O vibration peak (450 $cm^{-1}$) and a Si—C stretching peak (800 to 820 $cm^{-1}$) respectively. Positional variations of the value of O/Si and C/Si of the surface layer according to the present invention, formed by a method described below, can hardly occur, and the measurement is sufficient to be made at one point on the surface layer.

A method for forming the SiOx film according to the present invention on the elastic layer includes the following: wet coating methods, such as dip coating, spray coating, roll coating, and ring coating; physical vapor deposition (PVD) methods, such as vacuum deposition, sputtering, and ion plating; chemical vapor deposition (CVD) methods, such as plasma CVD, thermal CVD, and laser CVD.

Above all, particularly, the plasma CVD method is preferable, considering the adhesion of the elastic layer and the surface layer (the SiOx film), processing time and temperature, the convenience of the apparatus, and the uniformity of the resulting surface layer.

An example of a method for forming a SiOx film by the plasma CVD method is shown below.

Figure 3:
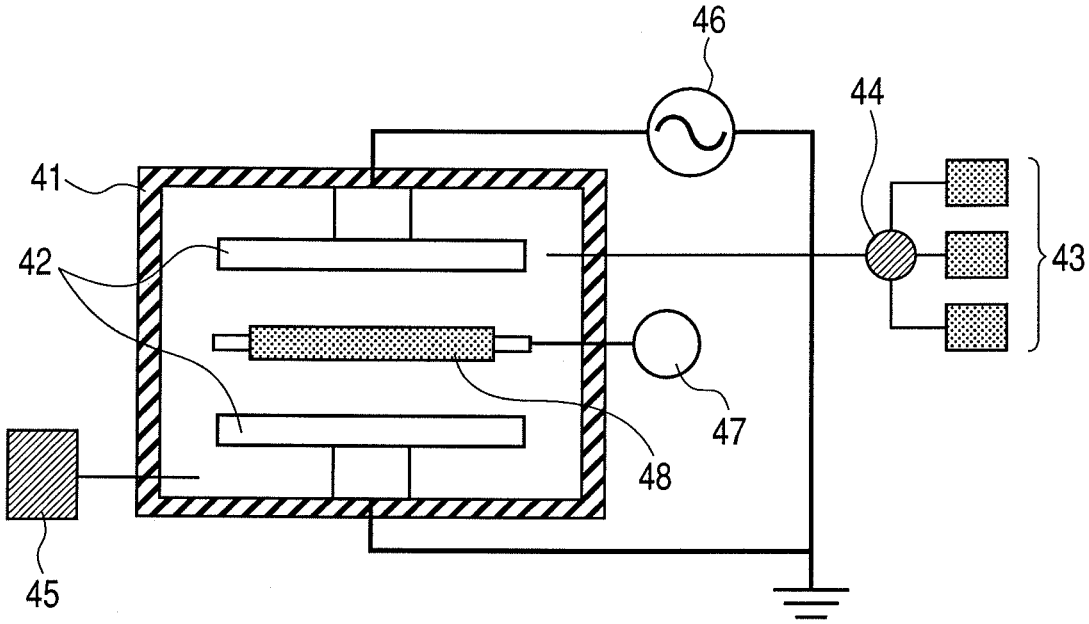
FIG. 3 is a schematic diagram of an apparatus for producing a SiOx film by a plasma CVD method.

FIG. 3 is a schematic diagram of an apparatus for forming a SiOx film by this plasma CVD method.

The apparatus includes a vacuum chamber 41, plate electrodes 42 placed in parallel, raw material gas cylinders and raw material liquid tanks 43, a raw material supply unit 44, a unit 45 for exhausting the gas in the chamber, a high frequency supply power source 46 for supplying high frequency, and motor 47 for rotating an elastic roller 48.

A developing roller having a SiOx film as a surface layer can be produced by the following procedures (1) to (4), using the apparatus illustrated in FIG. 3.

Procedure (1): The elastic roller 48 in which an elastic layer is formed on a mandrel is placed between the plate electrodes 42 and is rotated in the circumferential direction by driving the motor 47 so that a SiOx film to be obtained is uniform.

Procedure (2): The inside of the vacuum chamber 41 is evacuated by the exhaust unit.

Procedure (3): A raw material gas is introduced from a raw material gas introduction port, and high-frequency power is supplied to the plate electrodes 42 by the high frequency supply power source 46 to generate plasma to form a film.

Procedure (4): After a predetermined time passes, raw material gas and high-frequency power supply are stopped, and air or nitrogen is introduced (leaked) into the vacuum chamber 41 to atmospheric pressure, and then, the elastic roller 48 is removed.

It is possible to produce a developing roller having a surface layer including a SiOx film containing carbon by the procedures as described above. Many elastic rollers 48 may be simultaneously treated by plasma CVD if they can be placed in a uniform plasma atmosphere.

A gaseous or gasified organosilicon compound for a raw material gas is usually introduced, together with a hydrocarbon compound as required, in the coexistence of or in the absence of gas, such as an inert gas and an oxidizing gas. Examples of the above hydrocarbon compound include, for example, toluene, xylene, methane, ethane, propane, and acetylene.

The organosilicon compound includes the following: 1,1,3,3-tetramethyldisiloxane, hexamethyldisiloxane, vinyltrimethylsilane, methyltrimethoxysilane, hexamethyldisilane, methylsilane, dimethylsilane, trimethylsilane, tetramethylsilane, diethylsilane, propylsilane, phenylsilane, vinyltriethoxysilane, vinyltrimethoxysilane, tetramethoxysilane, tetraethoxysilane, phenyltrimethoxysilane, methyltriethoxysilane, and octamethylcyclotetrasiloxane.

1,1,3,3-tetramethyldisiloxane, hexamethyldisiloxane, and tetramethylsilane are preferable in terms of safety in handling.

A silane source is not limited to the organosilicon compound, and silane, aminosilane and silazane can also be used.

When the organosilicon compound and the like are gaseous, they are used as they are. When the organosilicon compound and the like are liquid at room temperature, they are heated, vaporized, and conveyed by an inert gas, or bubbled by an inert gas and conveyed for use. Further, an organosilicon compound and the like that are solid at room temperature are heated, vaporized, and conveyed by an inert gas for use. Vaporization of the raw material substances may be accelerated at reduced pressure.

It is possible to deposit a SiOx film even without oxygen when the raw material organosilicon compound is an oxygen-containing compound. Also, an oxidizing gas, such as oxygen and an oxidative gas ($N_2O$, $CO_2$, etc.), is introduced into the vacuum chamber, along with the above raw material gas, or in addition to the raw material gas. As the inert gas that can be used in the above, helium, argon and nitrogen may be cited.

The abundance ratio of silicon atoms, oxygen atoms chemically bonded to silicon atoms, and carbon atoms chemically bonded to silicon atoms in the SiOx film can be controlled by the compounding ratio of the raw material gases to be introduced, the high-frequency power to be supplied, and the like.

Specifically, for example, the value of O/Si can be increased by increasing the ratio of oxygen gas in the compounding ratio of the above described organosilicon compound and oxygen gas. The value of C/Si can be increased by decreasing the ratio of oxygen gas.

Also, the values of O/Si and C/Si can be decreased by increasing high-frequency power. Further, when using the above described hydrocarbon compound together, the values of O/Si and C/Si can be increased according to the amount of the hydrocarbon compound used.

The following method is shown as a method for producing a SiOx film by a wet method.

A method in which a mixture of an inorganic polymer precursor solution (for example, a perhydropolysilazane solution) and a solution of a polymer having a hydroxyl group (for example, 2-hydroxyethyl methacrylate) is uniformly applied on an elastic layer, and then, the coating film of the mixture is cured by heating or irradiation with ultraviolet light.

In the above method, the values of O/Si and C/Si can be controlled by changing the molar ratio of the above inorganic polymer precursor solution and the above polymer solution.

Before the raw material mixture for a SiOx film is applied on the elastic layer, the surface of the elastic layer may be subjected to activation treatment, such as irradiation with ultraviolet light or electron beams, or plasma treatment, so that the mixture can be well applied.

The thickness of the SiOx film formed in this manner is preferably 15 nm or more and 5000 nm or less, and more preferably 300 nm or more and 3000 nm or less. When the film thickness is set to be in the above numerical value range, the SiOx film is also practically sufficient for wear associated with long-term use. Also, even if the SiOx film is manufactured by the above described CVD method, the temperature of the elastic layer can be effectively inhibited from being excessively raised so that the properties of the elastic layer change.

The film thickness of the formed SiOx film is defined as an average value of measurements for 3 spots equally spaced in the peripheral direction of the developing roller for each of 3 spots equally spaced in the lengthwise direction from the end portion, 9 spots in total, measured with a thin film measuring device (trade name: F20-EXR, manufactured by FILMETRICS).

Figure 4:
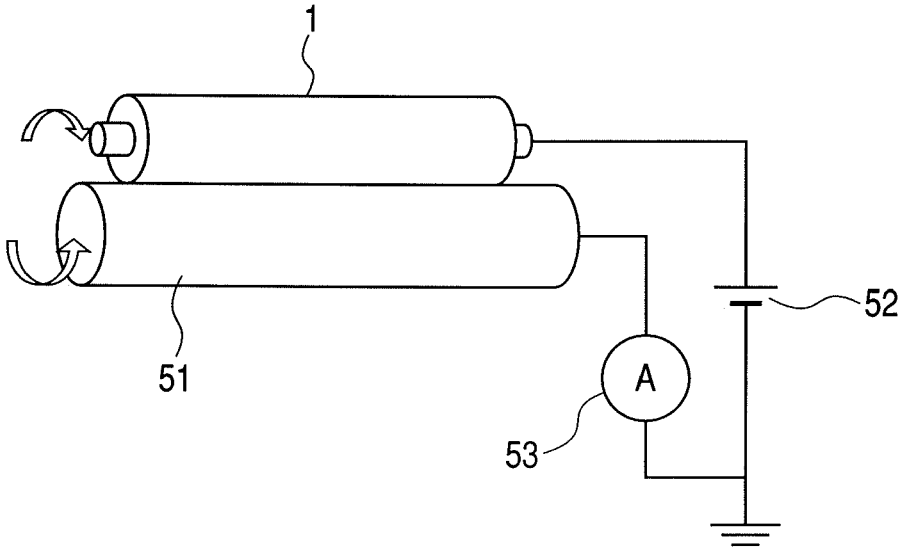
FIG. 4 is an explanatory view illustrating a method for measuring the current value of the developing roller.

In the developing roller of the present invention, the current value measured when DC 50 V is applied to the developing roller that is rotating, as in FIG. 4, is preferably 5 μA or more and 5000 μA or less, and more preferably 100 μA or more and 500 μA or less. If the current value is set to be in the above numerical value range, a developing bias sufficient for development can be easily obtained when an electrostatic latent image formed on an electrophotographic photosensitive drum is developed with toner. Therefore, an electrophotographic image having sufficient density can be obtained. Even though pinholes occur on the surface of the electrophotographic photosensitive drum, bias leak is difficult to bring about, so that transverse streaks caused by the pinholes can be effectively inhibited from occurring in the electrophotographic image.

A load of 500 g is applied to each of the exposed portions of the mandrel of developing roller 1 to bring the outer peripheral surface of the developing roller 1 with a cylindrical electrode 51 made of SUS and having a diameter of 40 mm. The cylindrical electrode 51 is rotated in this state, and the developing roller 1 is rotated in the circumferential direction at a speed of 24 rpm by associated rotation. When the rotation becomes stable, voltage is applied to the mandrel by a direct current power source 52, and a voltage of 50 V is applied between the mandrel and the cylindrical electrode. The environment at this time is 20° C. and 50% RH, where current values are measured for one rotation of the developing roller 1 with an ammeter 53, and the average value of the current values is defined as the current value. In the present specification, the current value measured in this manner is referred to as "the current value of the developing roller". Controlling this current value of the developing roller properly and uniformly is important in terms of keeping electric field strength for toner movement proper and uniform.

The above developing roller of the present invention is useful as the developing roller of an image forming apparatus, such as a copying machine, a facsimile and a printer, and also as the developing roller of a process cartridge in a process cartridge type image forming apparatus.

Figure 5:
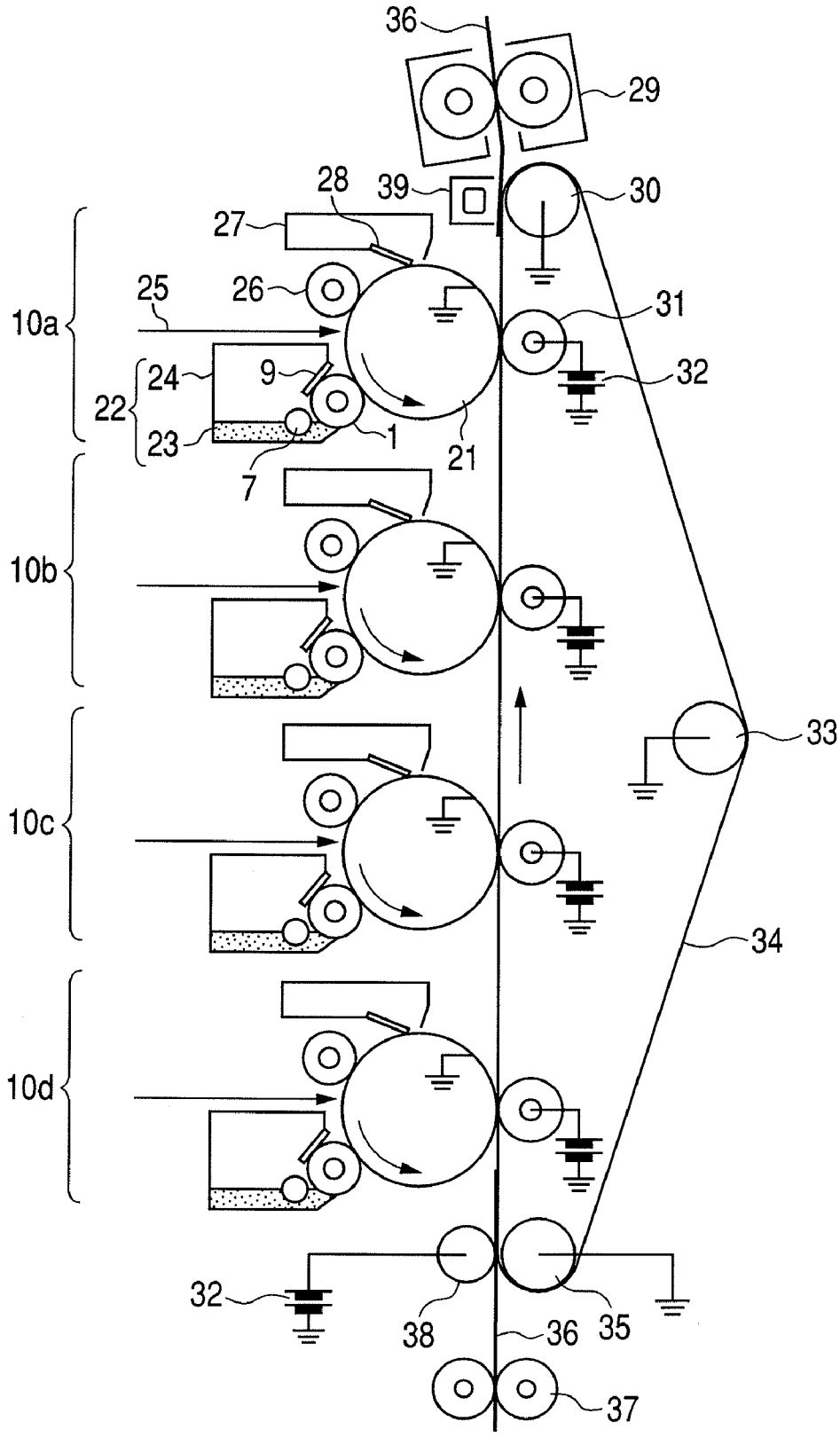
FIG. 5 is a schematic diagram illustrating an example of a developing apparatus in which the developing roller of the present invention is set.

A schematic diagram of one example of a color electrophotographic image forming apparatus in which the developing roller of the present invention is set is illustrated in FIG. 5. Description will be given below with reference to FIG. 5.

The color electrophotographic image forming apparatus illustrated in the schematic diagram of FIG. 5 has image forming portions 10 (10*a* to 10*d*), which are provided for each of color toners of yellow Y, magenta M, cyan C, and black BK, in a tandem form. The image forming portions 10 are slightly different in specifications according to respective color toner properties, but are the same in basic configuration. The image forming portion 10 is provided with the photosensitive drum 21 as a latent image bearing member that rotates in the arrow direction. A charging member 26 for uniformly charging the photosensitive drum 21, an exposure unit 21 for irradiating the uniformly charged photosensitive drum 21 with laser light 25 to form an electrostatic latent image, and the developing apparatus 22 for supplying toner to the photosensitive drum 21 on which the electrostatic latent image is formed and developing the electrostatic latent image are placed around photosensitive drum 21. Further, a transfer member is provided having a transfer roller 31 for transferring the toner image on photosensitive drum 21 onto recording medium 36, such as paper, which is fed by a pair of paper feed rollers 37 and conveyed by a conveying belt 34, by applying a bias power source 32 from the back surface of a recording medium 36. The conveying belt 34 is fitted over and around a driving roller 30, a driven roller 35 and a tension roller 33, and is so controlled as to move in synchronization with the image forming portions and convey the recording medium 36 so that the toner images formed in the respective image forming portions are sequentially superposed and transferred on the recording medium 36. The recording medium 36 is electrostatically adsorbed to the conveying belt 34 by operation of an adsorption roller 38 placed immediately before the conveying belt 34 and is conveyed.

Further, the color electrophotographic image forming apparatus is provided with a fixing apparatus 29 for fixing the toner images superposed and transferred on the recording medium 36 by heating or the like, and a conveying apparatus (not illustrated) for discharging the recording medium on which the image is formed, out of the color electrophotographic image forming apparatus. The recording medium 36 is peeled from the conveying belt 34 by operation of a peeling apparatus 39 and sent to the fixing apparatus 29.

The image forming portion 10 is provided with a cleaning member having a cleaning blade 28 for removing the transfer residual toner that is not transferred to the recording medium and remains on photosensitive drum 21 and remains, and cleaning the surface, and a waste toner container 27 for storing the toner scraped off from the photosensitive drum. The cleaned photosensitive drum 21 is made capable of forming an image and stands ready.

The photosensitive drum 21, charging member 26, developing apparatus 22, cleaning blade 28, and waste toner container 27 can also be integrated into a process cartridge.

The developing apparatus 22 placed in the above image forming portion 10 is provided with the toner container 24 containing toner 23, and the developing roller 1 that is placed to block the opening of the toner container and is opposed to the photosensitive drum in the portion exposed from the toner container. The toner container 24 is provided with a roller-shaped toner applying member 7 that comes in contact with the developing roller 1 and supplies the toner to the developing roller 1, and a toner amount regulating blade 9 that forms the toner supplied to developing roller 1 into a thin film and performs frictional charging. As the toner applying member 7, for example, one in which a foam sponge or polyurethane foam is formed on a shaft and one having a fur brush structure in which fibers of rayon, polyamide, or the like are implanted, are preferable in terms of removing the residual toner on the developing roller 1. It is preferable that the toner applying member 7 can be placed having a suitable contact width with the developing roller 1, and can be rotated in the direction counter to the developing roller 1 in the abutting portion.

Figure 6:
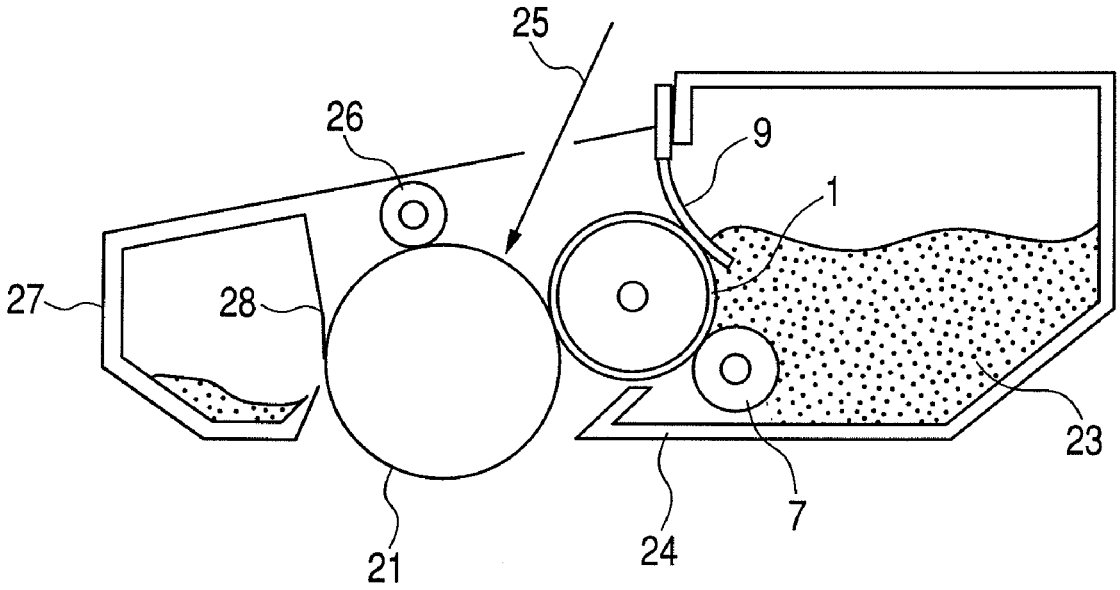
FIG. 6 is a schematic diagram illustrating a process cartridge on which the developing roller of the present invention is mounted.

The process cartridge of the present invention is detachable from the electrophotographic image forming apparatus body and includes the above developing roller, as described above. A schematic diagram of an example of a process cartridge for a monochrome image forming apparatus is illustrated in FIG. 6.

The developing roller 1 is placed in contact with the photosensitive drum 21 and the toner applying member 7. Toner 23 placed in the toner container 24 can be supplied to the developing roller 1 by the toner applying member 7. In this case, the amount of the toner is adjusted by the toner amount regulating blade 9. An electrostatic latent image is formed by laser light 25 on the photosensitive drum 21 charged by the charging member 26, and the electrostatic latent image is visualized by the toner carried and conveyed on the developing roller 1, to be a toner image. This toner image on the photosensitive drum 21 is transferred onto a recording medium, such as paper. Then, the toner remaining on the photosensitive drum 21 is scraped off by the cleaning blade 28 into the waste toner container 27.

EXAMPLES

The present invention will be more specifically described below by way of working examples, but the present invention it not limited thereto.

The reagents used herein have a purity of 99.5% or more unless otherwise specified.

Manufacturing Example 1

Manufacture of Elastic Roller 1

The following materials were blended to prepare a base material of liquid silicone rubber.

100 parts by mass of dimethylpolysiloxane having a vinyl group at both ends (vinyl group content: 0.15 mass %), 7 parts by mass of quartz powder as filler (trade name: Min-USil, manufactured by Pennsylvania Glass Sand), and 10 parts by mass of carbon black (trade name: DENKA BLACK, powdered product, manufactured by DENKI KAGAKU KOGYO KABUSHIKI KAISHA).

0.5 parts by mass of a complex of chloroplatinic acid and divinyltetramethyldisiloxane (0.5 mass %) as a curing catalyst was blended with the above base material to prepare a solution A. Also, 1.5 parts by mass of a dimethylsiloxane-methylhydrogensiloxane copolymer having a Si—H group at both ends (the content of H bonded to Si atoms: 0.30%) was combined with the above base material to prepare a solution B.

A columnar mandrel that was made of SUM material, had a diameter of 6 mm and a length of 250 mm, and had a surface treated with a primer, was placed at the center of a cylindrical die. A mixture of the above solution A and solution B in a mass ratio of 1:1 was injected into this die, heated and cured at a temperature of 130° C. for 20 minutes, and further post-cured at a temperature of 200° C. for 4 hours to produce an elastic roller 1 with an elastic layer having a length of 240 mm and a thickness of 3 mm.

Manufacturing Example 2

Manufacture of Elastic Roller 2

The following materials were melted and kneaded, and extruded using a twin screw extruder having a diameter of 30 mm and an L/D of 32 to prepare a resin mixture.

100 parts by mass of a polyolefin elastomer (trade name: Santoprene 8211-25, manufactured by AES Japan), and 40 parts by mass of MT carbon black (trade name: Thermax Floform N990, manufactured by CANCARB).

Then, the above resin mixture was pelletized. A resin layer was formed from these pellets on an mandrel (diameter: 6 mm, and length: 250 mm), using a crosshead extruder. The ends of this resin layer were cut, and further, the resin layer portion was ground by a grindstone to produce an elastic roller 2 with an elastic layer having a thickness of 3 mm.

Manufacturing Example 3

Manufacture of Elastic Roller 3

An elastic roller 3 was produced in the same manner as in the above Manufacturing Example 2, except that the polyolefin elastomer (Santoprene 8211-25, manufactured by AES Japan) was changed to an olefin elastomer (trade name: Santoprene 8211-45, manufactured by AES Japan).

Manufacturing Example 4

Manufacture of Elastic Roller 4

An elastic roller 4 was produced in the same manner as in the above Manufacturing Example 2, except that the polyolefin elastomer (trade name: Santoprene 8211-25, manufactured by AES Japan) was changed to LDPE (trade name: Novatec LD LJ902, manufactured by Japan Polyethylene Corporation).

Manufacturing Example 5

Manufacture of Elastic Roller 5

Elastic roller 5 was produced in the same manner as in the above Manufacturing Example 2, except that the polyolefin elastomer (trade name: Santoprene 8211-25, manufactured by AES Japan) was changed to LDPE (trade name: Novatec LD LJ802, manufactured by Japan polyethylene Corporation).

Manufacturing Example 6

Manufacture of Elastic Roller 6

Elastic roller 6 was produced in the same manner as in the above Manufacturing Example 2, except that the polyolefin elastomer (trade name: Santoprene 8211-25, manufactured by AES Japan) was changed to EVA (trade name: EVAFLEX EV45LX, manufactured by DuPont-Mitsui Polychemicals Co., Ltd.).

Example 1

Elastic roller 1 was installed in the plasma CVD apparatus illustrated in FIG. 3. Subsequently, the pressure in the vacuum chamber was reduced to 1 Pa, using a vacuum pump. Subsequently, a mixed gas of 1.0 sccm of hexamethyldisiloxane vapor, 1.5 sccm of oxygen and 22.5 sccm of argon gas, as a raw material gas, was introduced into the vacuum chamber, and the pressure in the vacuum chamber was set to be 25.3 Pa. After the pressure became constant, power of 120 W at a frequency of 13.56 MHz was supplied to plate electrodes from a high-frequency power source to generate plasma between the electrodes. The elastic roller 1 installed in the vacuum chamber was rotated at 24 rpm and treated for 3 minutes. After the treatment was finished, power supply was stopped, the raw material gas remaining in the vacuum chamber was evacuated, and air was introduced into the vacuum chamber to atmospheric pressure. Subsequently, the developing roller on which a surface layer was formed was taken out.

The abundance ratio of O/Si and the abundance ratio of C/Si on the surface of the obtained developing roller were determined using an X-ray photoelectron spectrometer to be 1.56 and 0.32, respectively.

The film thickness of the surface layer of the developing roller was measured using a thin film measuring apparatus (trade name: F20-EXR, manufactured by FILMETRICS), and found to be 1530 nm. The measurement was performed at three spots equally divided in the peripheral direction of the developing roller for each of three spots equally divided in the lengthwise direction, nine spots in total, and the average value of the obtained values was determined as the film thickness.

Further, the current value of the developing roller was measured with a voltage of 50 V applied and the developing roller rotated at a speed of 24 rpm in an environment of a temperature of 20° C. and a humidity of 50% RH, and found to be 270 μA.

The tensile modulus of the elastic layer having the surface layer (hereinafter referred to as "the elastic layer+the surface layer") was measured using a test piece 100 mm in length corresponding to half the circumference of the roller, prepared from the developing roller according to FIG. 2, and found to be 1.0 MPa. The tensile modulus was an average value of the values measured for five specimens by a universal tensile tester (trade name: Tensilon RTC-1250A, manufactured by ORIENTEC CO., LTD.) in a measurement environment of a temperature of 20° C. and a humidity of 60% RH.

Example 2

A developing roller was prepared in the same manner as in Example 1 except that the elastic roller 2 was used, and the time for which plasma CVD treatment was performed to form a surface layer was 4 minutes.

The various properties of the prepared developing roller were analyzed in the same manner as in Example 1. The results are shown in Table 1.

Example 3

A developing roller was obtained in the same manner as in Example 2 except that the time taken for plasma CVD treatment was 10 seconds. The analysis results of this developing roller are shown in Table 1.

Example 4

A developing roller was obtained in the same manner as in Example 2 except that the time taken for plasma CVD treatment was 8 seconds. The analysis results of this developing roller are shown in Table 1.

Example 5

A developing roller was obtained in the same manner as in Example 2 except that the time of plasma CVD treatment was 10 minutes. The analysis results of this developing roller are shown in Table 1.

Example 6

A developing roller was obtained in the same manner as in Example 2, except that the time taken for plasma CVD treatment was 11 minutes. The analysis results of this developing roller are shown in Table 1.

Example 7

A developing roller was obtained in the same manner as in Example 2 except that in the formation of a surface layer, the composition of the raw material gas was 1.0 sccm of hexamethyldisiloxane vapor, 2.5 sccm of oxygen, and 21.5 sccm of argon gas, and the time taken for plasma CVD treatment was 30 seconds. The analysis results of this developing roller are shown in Table 1.

Example 8

A developing roller was obtained in the same manner as in Example 2 except that in the formation of a surface layer, the composition of the raw material gas was 1.0 sccm of hexamethyldisiloxane vapor, 0.5 sccm of oxygen, and 23.5 sccm of argon gas, and the time taken for plasma CVD treatment was 6 minutes. The analysis results of this developing roller are shown in Table 1.

Example 9

A developing roller was obtained in the same manner as in Example 8 except that the time take for plasma CVD treatment was 3 minutes in the formation of a surface layer. The analysis results of this developing roller are shown in Table 1.

Example 10

A developing roller was obtained in the same manner as in Example 8 except that the time taken for plasma CVD treatment was 1 minute in the formation of a surface layer. The analysis results of this developing roller are shown in Table 1.

Example 11

A developing roller was obtained in the same manner as in Example 2 except that elastic roller 3 was used. The analysis results of this developing roller are shown in Table 1.

Example 12

A developing roller was obtained in the same manner as in Example 2 except that the elastic roller 4 was used. The analysis results of this developing roller are shown in Table 1.

Example 13

A developing roller was obtained in the same manner as in Example 1 except that the elastic roller 5 was used. The analysis results of this developing roller are shown in Table 1.

Example 14

A developing roller was obtained in the same manner as in Example 1 except that the elastic roller 6 was used. The analysis results of this developing roller are shown in Table 1.

Example 15

A developing roller was obtained in the same manner as in Example 2 except that the conditions for forming the surface layer were changed so that the raw material gas composition was 1.0 sccm of 1,1,3,3-tetramethyldisiloxane vapor, 2.5 sccm of oxygen, and 22.5 sccm of argon gas, the pressure in the chamber was 50.6 Pa, the high-frequency power source was 200 W at 13.56 MHz, and the time taken for plasma CVD treatment was 1 minute. The analysis results of this developing roller are shown in Table 1.

Example 16

A developing roller was obtained in the same manner as in Example 2 except that the raw material gas composition was changed to 1.0 sccm of tetramethylsilane vapor, 0.5 sccm of oxygen, and 22.5 sccm of argon gas, and the time taken for plasma CVD treatment was 10 minutes. The analysis results of this developing roller are shown in Table 1.

Example 17

The surface of the elastic layer of elastic roller 2 was surface treated with excimer light, and then, was coated with a mixed solution of 250 g of a perhydropolysilazane solution (trade name: AQUAMICA NP110-5, manufactured by AZ Electronic Materials) and 3 g of 2-hydroxyethyl methacrylate by a dipping method. Subsequently, air drying was performed for one whole day and night to produce a developing roller in which a surface layer was formed. The analysis results of this developing roller are shown in Table 1.

Example 18

A developing roller was obtained in the same manner as in Example 1 except that the time taken for plasma treatment was 6 minutes in the formation of a surface layer. The analysis results of this developing roller are shown in Table 1.

Example 19

A developing roller was obtained in the same manner as in Example 1 except that the raw material gas composition was changed to 1.0 sccm of hexamethyldisiloxane vapor and 21.5 sccm of argon gas and the time taken for plasma CVD treatment was 3 minutes in the formation of a surface layer. The analysis results of this developing roller are shown in Table 1.

Example 20

A developing roller was obtained in the same manner as in Example 1 except that in the formation of the surface layer of Example 1, 20 sccm of hexamethyldisiloxane vapor as a raw material gas composition was introduced into the vacuum chamber, the pressure in the vacuum chamber was set to be 6 Pa, and a power of 150 W was supplied to the parallel plate electrodes from the high-frequency power source to perform treatment for 5 minutes. The analysis results of this developing roller are shown in Table 1.

Example 21

A developing roller was obtained in the same manner as in Example 20 except that in the formation of the surface layer of Example 20, a mixed gas of 10 sccm of hexamethyldisiloxane vapor and 10 sccm of toluene vapor as a raw material gas was introduced into the vacuum chamber, and the pressure in the vacuum chamber was set to be 6 Pa. The analysis results of this developing roller are shown in Table 1.

Example 22

A developing roller was obtained in the same manner as in Example 21 except that in the formation of the surface layer, 3 sccm of hexamethylsiloxane vapor as a raw material gas was introduced into the vacuum chamber, the pressure in the vacuum chamber was set to be 2 Pa, and a power of 200 W was supplied to the parallel plate electrodes from the high-frequency power source. The analysis results of this developing roller are shown in Table 1.

Example 23

A developing roller was obtained in the same manner as in Example 22 except that in the formation of the surface layer, a mixed gas of 10 sccm of hexamethyldisiloxane vapor and 20 sccm of toluene vapor as a raw material gas was introduced into the vacuum chamber, the pressure in the vacuum chamber was set to be 8 Pa, and a power of 30 W was supplied to the parallel plate electrodes from the high-frequency power source. The analysis results of this developing roller are shown in Table 1.

Comparative Example 1

A developing roller was obtained in the same manner as in Example 1 except that in the formation of the surface layer, the raw material gas composition was changed to 1.0 sccm of tetramethylsilane vapor, 2.5 sccm of oxygen, and 21.5 sccm of argon gas, and the time taken for plasma CVD treatment was 2 minutes. The analysis results of this developing roller are shown in Table 1.

Comparative Example 2

A developing roller was obtained in the same manner as in Example 20 except that in the formation of the surface layer, 30 sccm of hexamethyldisiloxane vapor as a raw material gas was introduced into the vacuum chamber, the pressure in the vacuum chamber was set to be 6 Pa, and a power of 200 W was supplied from the high-frequency power source. The analysis results of this developing roller are shown in Table 1.

Comparative Example 3

A mixed solution containing methyl ethyl ketone as a main solvent was prepared in which the concentration of a heat curing silicone adhesive sealing agent (trade name: TSE3251-C, manufactured by Momentive Performance Materials) was adjusted to 5% in terms of solid content. 21 parts by weight (based on the resin component) of carbon black (trade name: DENKA BLACK, manufactured by DENKI KAGAKU KOGYO KABUSHIKI KAISHA, powdered product) was added to this mixed solution, and was sufficiently stirred to prepare a coating solution for forming a surface layer.

The elastic roller 1 in which the surface of the elastic layer was surface treated with excimer light was dipped in the above coating solution, pulled up, dried, and further heat treated at 140° C. for 2 hours to produce a developing roller. The analysis results of this developing roller are shown in Table 1.

TABLE 1

| | Abundance ratio O/Si | Abundance ratio C/Si | Surface layer film thickness (nm) | Current value (μA) | Tensile modulus (MPa) |
|---|---|---|---|---|---|
| Ex. 1 | 1.56 | 0.32 | 1530 | 270 | 1.0 |
| Ex. 2 | 1.53 | 0.36 | 1940 | 252 | 10.0 |
| Ex. 3 | 1.50 | 0.41 | 18 | 550 | 10.0 |
| Ex. 4 | 1.52 | 0.33 | 12 | 1260 | 10.0 |
| Ex. 5 | 1.53 | 0.37 | 4895 | 8 | 10.0 |
| Ex. 6 | 1.58 | 0.33 | 5030 | 4 | 10.0 |
| Ex. 7 | 1.78 | 0.12 | 313 | 15 | 10.0 |
| Ex. 8 | 1.31 | 0.65 | 2976 | 495 | 10.0 |
| Ex. 9 | 1.38 | 0.65 | 1320 | 3540 | 10.0 |
| Ex. 10 | 1.33 | 0.68 | 670 | 4928 | 10.0 |
| Ex. 11 | 1.52 | 0.35 | 2030 | 243 | 30.0 |
| Ex. 12 | 1.48 | 0.39 | 2160 | 290 | 90.0 |
| Ex. 13 | 1.51 | 0.33 | 1469 | 470 | 110.0 |
| Ex. 14 | 1.51 | 0.38 | 1520 | 395 | 0.8 |
| Ex. 15 | 1.95 | 0.05 | 515 | 6 | 10.0 |
| Ex. 16 | 1.00 | 1.00 | 3927 | 5140 | 10.0 |
| Ex. 17 | 1.56 | 0.51 | 2200 | 16 | 10.0 |
| Ex. 18 | 1.50 | 0.33 | 3008 | 48 | 1.0 |
| Ex. 19 | 0.98 | 1.23 | 1115 | 5830 | 1.0 |
| Ex. 20 | 0.65 | 1.65 | 345 | 258 | 1.0 |
| Ex. 21 | 1.95 | 0.65 | 1300 | 8 | 1.0 |
| Ex. 22 | 0.65 | 0.05 | 210 | 2 | 1.0 |
| Ex. 23 | 1.90 | 1.65 | 363 | 2973 | 1.0 |
| Com. Ex. 1 | 1.98 | 0.03 | 985 | 0.6 | 1.0 |
| Com. Ex. 2 | 0.53 | 1.42 | 643 | 1250 | 1.0 |
| Com. Ex. 3 | 0.98 | 1.95 | 4873 | 23 | 1.0 |

(Evaluation 1)

The following evaluation was performed for the developing rollers obtained in the above Examples and Comparative Examples. The evaluation results are shown in Table 2.

The laser printer used for evaluation (trade name: LASER SHOT LBP-1310, manufactured by Canon) is a machine in which A4 paper is discharged in its longitudinal direction, the recording medium output speed is 16 ppm, and the image resolution is 1200 dpi. The contact pressure and the penetration level of the toner amount regulating blade to the developing roller were set so that the amount of the toner carried on the developing roller was 0.35 mg/cm$^2$.

(1) Evaluation of Presence or Absence and Extent of Image Defects Resulting from Cracks in Surface Layer Each of the developing rollers in each of Examples and Comparative Examples was set in a cartridge of an electrophotographic laser printer (trade name: LASER SHOT LBP-1310, manufactured by Canon Inc.) as a developing roller. This cartridge was installed in the above electrophotographic laser printer, and electrophotographic images were output in an environment of a temperature of 25° C. and a humidity of 50% RH. Specifically, using a black toner, 10,000 sheets of 1% printed matter were output, and then, a solid black image and a halftone image were output one by one in turn. A halftone image has a density of 0.7 as measured using a densitometer (trade name: Macbeth Color Checker RD-1255, manufactured by Macbeth). Image defects resulting from cracks in the surface layer were evaluated for the solid black image and the halftone image according to the following criteria.

"no": No streaks caused by cracks in the surface layer of the developing roller are observed in the images.

"slight": Streaks caused by cracks in the surface layer of the developing roller are observed in the images, but practically no problem.

"yes": Streaks caused by cracks in the surface layer of the developing roller are observed in the images.

(2) Filming

The surface of the developing roller, after the images used for the evaluation of the above (1) were output, was observed with a microscope (trade name: Digital Microscope VH-8000, manufactured by KEYENCE). Then, the presence or absence of filming, and the presence or absence of image defects resulting from filming in the images used for the evaluation of the above (1) were evaluated according to the following criteria.

"A": No filming on the developing roller.

"B": Slight toner filming occurs on the developing roller, but image defects caused by the filming are not observed in the evaluated images.

"C": Toner filming on the developing roller occurs, and image defects caused by the filming are observed in the evaluated images.

(3) Exudation

The effect of suppressing the exudation of low molecular weight substances from the elastic layer of the developing roller by the surface layer according to the present invention was tested as follows.

A new developing roller in each of the Examples and Comparative Examples was set in a process cartridge, and the process cartridge was left standing in an environment of 40° C. and 95% RH for 30 days, with the developing roller being kept in contact with the toner amount regulating blade and the photosensitive drum. Subsequently, the process cartridge after being left standing was installed in a laser printer, and a solid black image and a halftone image were output. The images were visually observed, and the presence or absence and extent of the occurrence of defects in the electrophotographic images due to exudates from the elastic layer being attached to the photosensitive drum were evaluated according to the following criteria.

"no": There are no image defects due to attachment of exudates.

"slight": Image defects due to attachment of exudates are slightly observed, but practically no problem.

"yes": Image defects due to attachment of exudates are observed.

TABLE 2

| Evaluation item | (1) Image defects resulting from cracks in surface layer | (2) Filming | (3) Exudation |
|---|---|---|---|
| Ex. 1 | No | A | No |
| Ex. 2 | No | A | No |
| Ex. 3 | No | A | No |
| Ex. 4 | No | A | No |
| Ex. 5 | No | A | No |
| Ex. 6 | No | A | No |
| Ex. 7 | No | A | No |
| Ex. 8 | No | A | No |
| Ex. 9 | No | A | No |
| Ex. 10 | No | A | No |
| Ex. 11 | No | A | No |
| Ex. 12 | No | A | No |
| Ex. 13 | No | A | No |
| Ex. 14 | No | A | No |
| Ex. 15 | Slight | A | No |
| Ex. 16 | No | B | Slight |
| Ex. 17 | No | A | No |
| Ex. 18 | No | A | No |
| Ex. 19 | No | B | Slight |
| Ex. 20 | No | B | Slight |
| Ex. 21 | Slight | B | No |
| Ex. 22 | No | A | Slight |
| Ex. 23 | Slight | B | No |
| Com. Ex. 1 | Yes | A | Yes |
| Com. Ex. 2 | No | B | Yes |
| Com. Ex. 3 | No | C | No |

As shown in Table 2, it was found from the result of evaluation item (1) that the developing rollers according to the present invention had sufficient flexibility. Also, it was found from the result of evaluation item (2) that the developing rollers according to the present invention had a surface excellent in toner release properties. Further, it was found from the result of evaluation item (3) that the developing rollers according to the present invention could effectively suppress the exudation of low molecular weight components from the elastic layer.

(Evaluation 2)

Next, each of the developing rollers in Examples 1 to 23 was further evaluated for the following evaluation items (4) to (9).

(4) Fogging

Reflection density was measured by a photovoltaic reflection densitometer (trade name: TC-6DS/A, manufactured by Tokyo Denshoku Cc., Ltd.) for the solid white image output in the evaluation item (1). The difference in reflection density between the solid white image and an unprinted portion was defined as fogging (%), and the fogging was evaluated according to the following criteria.

A: less than 1.5%

B: 1.5% or more and less than 3.0%

C, 3.0% or more (5) Image Density

A solid black image output with a new developing roller prepared in each of the Examples and Comparative Examples, and the solid black image output in the above evaluation item (1), were measured using a densitometer (trade name: Macbeth Color Checker RD-1255, manufactured by Macbeth), and evaluated according to the following criteria.

A: Both are 1.3 or more and less than 1.6.

B: One is 1.3 or more and less than 1.6, but the other is less than 1.3 or 1.6 or more.

C: Both are less than 1.3 or 1.6 or more.

(6) Density Unevenness

Density unevenness was visually observed for the solid black image and halftone image output in the above evaluation item (1) and evaluated by the following criteria. Density unevenness generally appears most easily in a halftone image and appears relatively easily in a solid black image.

A: Density unevenness is not observed by a naked eye in both images, and the images are good for density unevenness.

B: Density unevenness is observed in the halftone image, and density unevenness is not observed in the solid black image.

C: Density unevenness is observed in both images.

(7) Leak Image

The presence or absence and extent of the occurrence of transverse streaks occurring with the period of the photosensitive drum were visually observed for the solid black image and halftone image output in the above evaluation item (1), and evaluated according to the following criteria.

"no": the occurrence of transverse streaks is not observed.

"slight": the occurrence of transverse streaks is slightly observed, but practically no problem.

"yes": the occurrence of transverse streaks is observed.

(8) Durability

The surface of the developing roller, after the images used for the evaluation of the above evaluation item (1) were output, was observed by a digital microscope (trade name: VH-8000, manufactured by KEYENCE CORPORATION). The presence or absence and extent of the peeling of the surface layer were observed, and evaluated by the following criteria.

"no": Peeling of the surface layer is not observed.

"slight": Slight peeling of the surface layer is observed.

"yes": Peeling of the surface layer is noticed.

(9) Set Properties

Set properties of the developing roller in contact with the toner amount regulating blade was tested as follows.

A brand new developing roller in each of the Examples was set in a process cartridge, and the process cartridge was left standing in an environment of 40° C. and 95% RH for 30 days, with the developing roller being brought into contact with the toner amount regulating blade. Subsequently, the process cartridge after being left standing was installed in the laser printer, and a solid black image and a halftone image were output. The images were visually observed, and the presence or absence and extent of the occurrence of transverse streaks due to impression caused by contact with the toner amount regulating blade were evaluated according to the following criteria.

"no": transverse streaks due to impression are not noticed.

"slight": transverse streaks due to impression are slightly observed, but practically no problem.

"yes": transverse streaks due to impression are observed.

The results of the above evaluation items (4) to (9) are shown in Table 3.

TABLE 3

| Evaluation item | (4) Fog | (5) Image density | (6) Density unevenness | (7) Leak image | (8) Durability | (9) Set |
|---|---|---|---|---|---|---|
| Ex. 1 | A | A | A | No | No | No |
| Ex. 2 | A | A | A | No | No | No |
| Ex. 3 | A | A | A | Slight | Slight | No |
| Ex. 4 | A | A | A | Slight | Yes | No |
| Ex. 5 | A | B | B | No | No | No |

TABLE 3-continued

| Evaluation item | (4) Fog | (5) Image density | (6) Density unevenness | (7) Leak image | (8) Durability | (9) Set |
|---|---|---|---|---|---|---|
| Ex. 6 | A | C | C | No | No | No |
| Ex. 7 | A | C | A | No | No | No |
| Ex. 8 | A | A | A | No | No | No |
| Ex. 9 | A | A | A | Slight | No | No |
| Ex. 10 | A | A | A | Yes | No | No |
| Ex. 11 | A | A | A | No | No | No |
| Ex. 12 | B | A | A | No | No | No |
| Ex. 13 | C | A | A | No | No | No |
| Ex. 14 | A | A | A | No | No | Yes |
| Ex. 15 | A | B | A | No | No | No |
| Ex. 16 | A | A | B | Yes | No | No |
| Ex. 17 | A | B | A | No | No | No |
| Ex. 18 | A | B | B | Slight | No | No |
| Ex. 19 | A | A | A | Yes | No | No |
| Ex. 20 | A | A | A | No | No | No |
| Ex. 21 | A | B | A | No | No | No |
| Ex. 22 | A | C | A | No | Slight | No |
| Ex. 23 | B | A | A | No | No | No |

This application claims the right of priority from Japanese Patent Application No. 2007-118781 filed on Apr. 27, 2007, the content of which is incorporated herein by reference as part of this application.

What is claimed is:

1. A developing roller for carrying and conveying toner and developing an electrostatic latent image on a photosensitive drum with the toner, the developing roller comprising in this order a mandrel, an elastic layer, and a surface layer, wherein the surface layer comprises a silicon oxide film containing a carbon atom chemically bonded to a silicon atom, and wherein the silicon oxide film has an abundance ratio of an oxygen atom forming a chemical bond with a silicon atom to a silicon atom (O/Si) of 0.65 or more and 1.95 or less, and an abundance ratio of the carbon atom chemically bonded to a silicon atom to a silicon atom (C/Si) of 0.05 or more and 1.65 or less.

2. The developing roller according to claim 1, wherein a film thickness of the surface layer is 15 nm or more and 5000 nm or less.

3. The developing roller according to claim 2, wherein the film thickness of the surface layer is 300 nm or more and 3000 nm or less.

4. The developing roller according to claim 1, wherein a tensile modulus of the elastic layer having the surface layer is 1.0 MPa or more and 100.0 MPa or less.

5. The developing roller according to claim 1, wherein a current value measured when a voltage of 50 V is applied to the developing roller that is rotating is 5 μA or more and 5000 μA or less.

6. The developing roller according to claim 1, wherein a surface of the elastic layer is covered with the surface layer, and the surface layer consists of the silicon oxide film.

7. An electrophotographic process cartridge that is detachably mountable on an electrophotographic image forming apparatus body, wherein a developing roller set in the cartridge is the developing roller according to claim 1.

8. An electrophotographic image forming apparatus comprising a photosensitive drum and a developing roller placed in contact with the photosensitive drum, wherein the developing roller is the developing roller according to claim 1.

* * * * *